United States Patent [19]

Gotti

[11] Patent Number: 4,967,804

[45] Date of Patent: Nov. 6, 1990

[54] FABRIC ROLLING UNIT OF TANGENTIAL TYPE, WITH A LOAD-CONTROL DEVICE

[75] Inventor: Massimo Gotti, Valbrembo, Italy

[73] Assignee: Formia Nuova S.r.l., Ponte San Pietro, Italy

[21] Appl. No.: 312,874

[22] Filed: Feb. 21, 1989

[30] Foreign Application Priority Data

Feb. 26, 1988 [IT] Italy ..... 19561 A/88

[51] Int. Cl.[5] ..... D03D 49/20

[52] U.S. Cl. ..... 139/308; 242/66

[58] Field of Search ..... 139/304, 307, 308–315; 242/54.4 X, 55.1, 65, 66 X

[56] References Cited

U.S. PATENT DOCUMENTS

| | | | |
|---|---|---|---|
| 2,519,424 | 8/1950 | Bahan | 139/308 |
| 3,236,471 | 2/1966 | Hornbostel | 242/66 |
| 3,306,547 | 2/1967 | Reid et al. | 242/66 |
| 3,433,430 | 3/1969 | Sprague | 139/308 |
| 3,568,944 | 3/1971 | Besserdich | 242/66 |
| 4,025,009 | 5/1977 | Fineo | 242/66 |
| 4,811,915 | 3/1989 | Smith | 242/66 |

*Primary Examiner*—Andrew M. Falik

*Attorney, Agent, or Firm*—R. Lewis Gable

[57] ABSTRACT

A fabric rolling unit comprises a pair of tangential fabric-rolling rollers, one of which is a driving roller and the other one is a driven roller, with the axes of said rollers being parallel to each other and horizontal, on which rollers either a beam tangentially rests, on which the fabric roll is wound, or the same fabric roll respectively rests. In order to make it possible for large-diameter fabric rolls to be obtained, the beam is supported in a freely revolving way at the upper ends of the stems of two vertical hydraulic cylinders. Inside the upper chamber of these cylinders a constant pressure is preset, whereas inside the lower chamber of said cylinders the pressure is controlled and varied by means of proportional valve. The proportional valve, in turn, is controlled via an electronic circuit, by a load cell which constantly monitors the variable load applied by the beam and by the fabric roll during the rolling process, so as to keep constant the load applied to the cell.

6 Claims, 2 Drawing Sheets

FABRIC ROLLING UNIT OF TANGENTIAL TYPE, WITH A LOAD-CONTROL DEVICE

The present invention relates to a fabric rolling unit operating by means of a tangential fabric rolling system.

Fabric rolling units of such a kind are commonly known in the art, and are used in order to collect fabrics manufactured on, and outcoming from, weaving looms and similar machines, as fabric rolls. Substantially, these fabric rolling units comprise, besides suitable guide and tensioning systems for guiding and tensioning the incoming fabric, a pair of tangential fabric-rolling rollers, with one of said rollers being a driving roller, and the other one being a driven roller, arranged with their axes being parallel to each other and horizontal, on which rollers a beam tangentially rests at the beginning of the rolling process and then, during the rolling process, the fabric roll rests, which is formed on the same beam. Normally, the ends of the beam, which can freely revolve around its own axis, are not supported, but are simply guided inside vertical guides, in order to enable said beam to vertically move upwards, as the diameter of the fabric roll being formed increases. The rotation of the beam, and, respectively, of the fabric roll under way of formation, occurs by simple tangential friction with the fabricrolling rollers, on which it freely rests thanks to its own weight.

These types of fabric rolling units have been widely adopted in the industry, and make it possible to obtain well-shaped fabric rolls up to a diameter of 1,000–1,200 mm, or slightly larger. However, considerable problems arise if larger-diameter fabric rolls have to be obtained, in particular if the handled fabrics are delicate, and/or low-resistance fabrics. In fact, with increasing roll diameters, the weight of the same roll correspondingly increases, and consequently noxious effects arise, which endanger the tangential rolling system, and impair the perfect integrity of the rolled fabric, particularly in the case of delicate fabrics. Furthermore, obtaining the end geometry of the rolls within narrow tolerances, is difficult.

In accordance therewith, the purpose of the present invention is to provide a fabric rolling unit, operating on the basis of the tangential rolling principle, capable of rolling any type of fabric, and, in particular, delicate fabrics, and of forming large-diameter fabric rolls (of up to 1,800–2,000 mm of diameter), with the end geometry of the obtained rolls being contained within very narrow tolerances, and without altering the quality of the manufactured fabric.

This purpose is achieved according to the present invention by means of a fabric rolling unit comprising a pair of tangential fabric-rolling rollers, with one of said rollers being a driving roller, and the other one being a driven roller. The rollers are positioned with their axes being parallel to each other and horizontal, and destined to tangentially support a beam, or, respectively, the roll of fabric which is being formed on said beam. The beam is supported at its ends, in a freely revolving way, inside openable supports, which are provided at the upper ends of the stems of two vertically positioned hydraulic cylinders. Inside the upper chamber of said cylinders a constant, calibratable pressure is preset. The pressure inside the lower chamber of said cylinders is variable and can be controlled by means of a proportional electrovalve. Load detector means are provided, which are suitable for detecting the variable weight of the fabric roll being formed, and for sending to said proportional electrovalve an electrical signal, so as to increase, as the weight of the roll of fabric increases, the pressure inside the lower chamber of the cylinders, and keep constant the load applied to said detector means.

Said detector means are advantageously so positioned, as to be exposed to the total load applied by both said tangential fabric-rolling rollers and by the beam with the fabric roll being formed, and such adjustment and calibration means are provided, as to cause the detector means to exclusively detect the actual weight of the fabric contained in the roll of fabric which is progressively formed during the rolling process.

According to a preferred form of practical embodiment, the tangential fabric-rolling rollers are supported, at one of their ends, inside supports swinging on a vertical plane, and at their other end, said rollers are supported inside supports mounted on a vertically-movable saddle, with said saddle resting on said detector means. In such a way, only a half of the load is detected, so that a cheaper size of the detector means can be selected.

A dynamometer with electrical-resistance strain gages, also known as "load cell", of the same type as commonly used also in balances, and in automatic weighing systems in general can be used as the detector means. Such a load cell converts the changes in strain due to load changes into an electrical output signal.

The invention is illustrated in greater detail in the following, on the basis of an example of practical embodiment schematically shown in the hereto attached drawings, in which.

Figure 1:
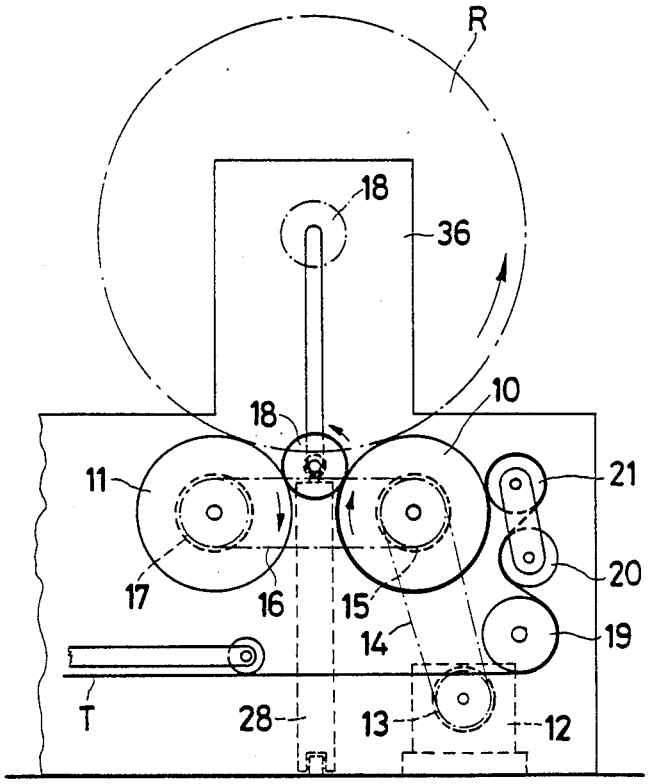
FIG. 1 shows a schematic side view of a fabric rolling unit.

The rolling unit comprises two tangential fabric-rolling rollers 10 and 11, positioned with their axes being parallel to, and spaced apart from, each other on a horizontal plane. The roller 10 is driven by a ratiomotor 12, whose output sprocket gear 13, by means of a chain 14, drives a sprocket gear 15 integral with the shaft of the roller 10 to revolve. By means of a chain 16, a sprocket gear 17 integral with the shaft of the driven roller 11 is driven to revolve. Both rollers 10 and 11 revolve therefore in the same direction, as shown by arrows in FIG. 1, and at slightly different speeeds.

Between the fabric-rolling rollers 10, 11, at the beginning of the rolling process, a beam 18 is placed, in a tangential position. This beam is hence driven to revolve by friction by the rollers 10 and 11.

The open-width fabric T, which arrives from a weaving loom or from another similar textile machine (not shown in the figures) is guided to run around return rollers 19, 20, 21, with the latter of said return rollers keeping the fabric T adherent to the periphery of the driving fabric-rolling roller 10, to partially wind around this latter return roller, and then to be rolled, according to successive turns, around the beam 18. It is clear that, owing to the formation of the roll of fabric R on the beam 18, it will be the outermost turn of fabric of the fabric roll R which will rest on the tangential fabric-rolling rollers 10 and 11.

Figure 3:
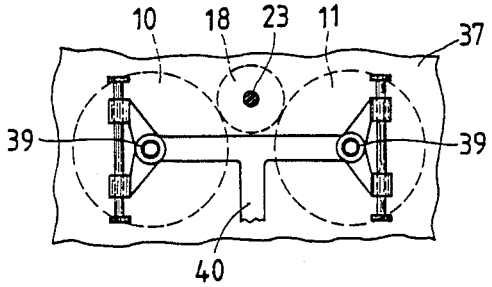
FIG. 3 shows a schematic side view of the same rolling unit taken along line III—III of FIG. 2.
Figure 2:
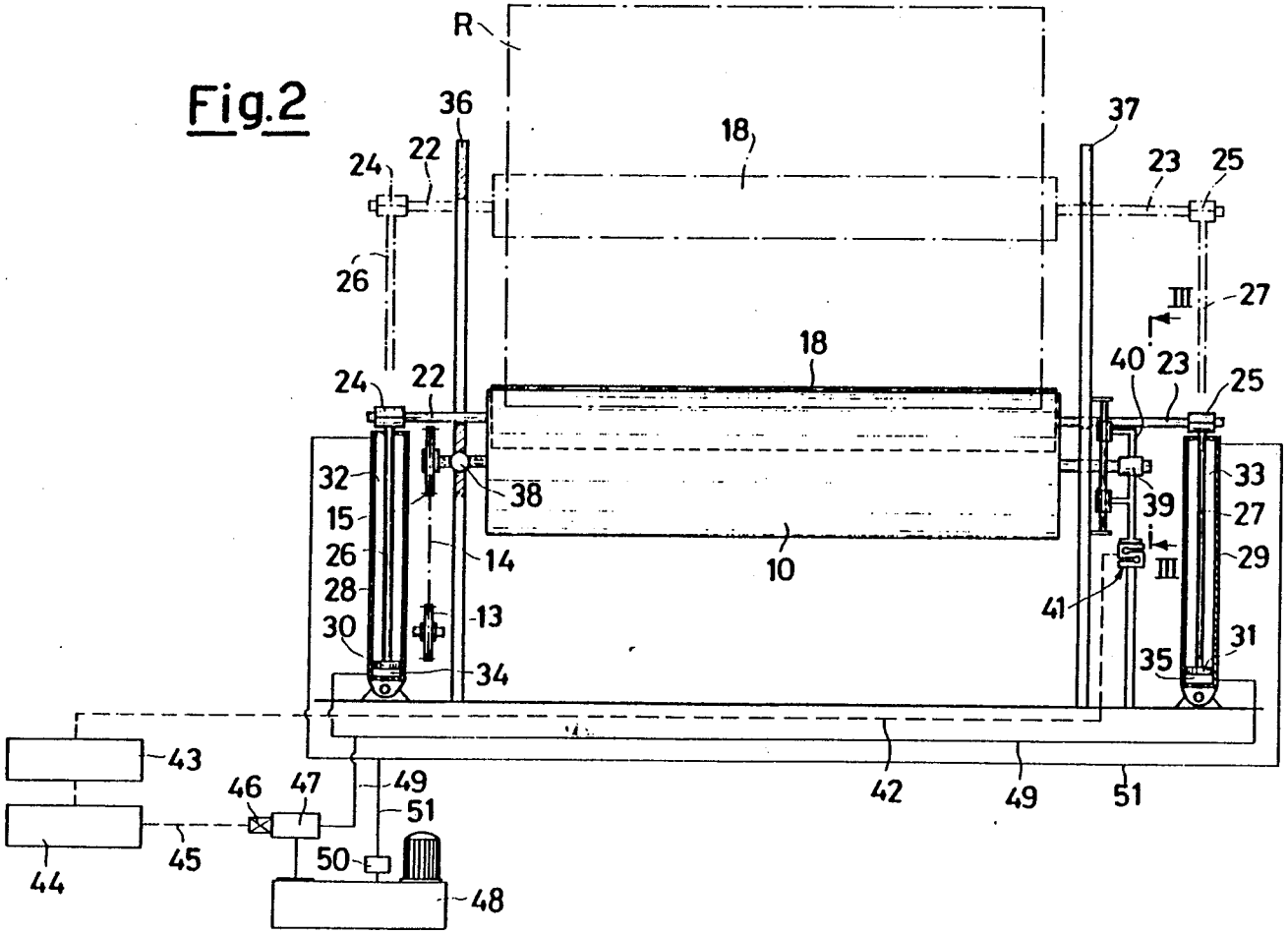
FIG. 2 shows a schematic front view of the same rolling unit.

As shown in FIGS. 2 and 3, the ends 22 and 23 of the shaft of the beam 18 are supported, with possibility of freely revolving, inside supports 24 and respectively 25, provided at both upper ends of the stems 26 and respectively 27 of vertically arranged hydraulic cylinders 28, 29. The pistons 30 and respectively 31 of said cylinders subdivide the inner chamber of the same cylinders into an upper chamber 32 and respectively 33, and a lower chamber 34 and respectively 35. The supports 24, 25 destined to support the ends of the shaft of the beam 18 can be opened, in order to make it possible to replace the beam. Vertical side walls 36, 37 of the framework of the rolling unit, only schematically depicted, serve to support the fabric-rolling rollers 10 and 11 in the way as it will be explained in the following.

At one of their ends (on the left in FIG. 2), the rollers 10, 11 are supported , with possibility of freely revolving, inside supports, such as the support 38, borne by the wall 36, which supports are endowed with the peculiar characteristic of being capable of limitedly swinging on a vertical plane, around an axis contained on the plane defined by the axes of the rollers 10, 11, and perpendicular to said axes.

At their other end (on the right in FIG. 2), the rollers 10, 11 are supported, with possibility of freely revolving, inside supports, such as the one indicated by the reference numeral 39, which are mounted on a saddle 40 guided to vertically move along the wall 37. Obviously, these supports are also mounted on the saddle 40 in such a way as to be able to slightly swing on vertical planes.

The saddle 40 rests, at its bottom side, on a load cell 41 (viz., a dynamometer with electrical-resistance strain gages), which is per se known, and, in its form as schematically shown in FIG. 2, has a "Z"-shape, and rests on fixed part. The function performed by this load cell (which, in practice, is a load-detector means) is, as well-known in the art, that of converting strain changes, generated by load changes, into an electrical output signal. It is hence a mechanical-electrical transducer.

The electrical output signal (in millivolts) generated by the load cell 41 is sent, through the line 42, to an electronic amplifier component 43, equipped with suitable adjustment and calibration means, which amplifies the signal received, and supplies, as its output, a corresponding amplified signal, which in turn is sent to a second electronic transducer component 44, also suitably adjustable. The transducer component 44 converts the signal received from the amplifier component 43 into an electrical current signal (in milliamperes), which is sent, through a line 45, to the solenoid 46 of a proportional electrovalve 47.

A hydraulic central control unit 48 precisely delivers pressurized fluid to the hydraulic cylinders 28 and 29 through the proportional electrovalve 47 and duct 49 to the lower chambers 34, 35 of said cylinders, and through a pressure control means 50 and duct 51, to the upper chambers 32, 33 of said cylinders.

The pressure $P_k$ inside the upper chamber 32, 33 of the hydraulic cylinders 28, 29 is constant, suitably calibrated by means of the pressure control means 50, while the pressure $P_x$ inside the lower chamber 34, 35 of said hydraulic cylinders 28, 29 is controlled by the proportional electrovalve 47 and is variable.

The load acting on the load cell 41 is substantially composed by the weights of both tangential fabric-rolling rollers 10, 11 and of the saddle 40, by the constant weight K of the beam 18, and by the variable load, $C_y$, constituted by the actual weight of the fabric during the rolling of the fabric around the beam.

On considering the above indicated pressures $P_k$ and $P_x$, the constant weight K of the beam 18, the variable load $C_y$ and the value of the constant load $C_k$ on the load cell 41, which one desires to maintain during the process of rolling of the fabric T on the beam 18, the following equation is valid:

$$C_y+P_k+K-P_x-C_k=0.$$

The value of the desired constant load $C_k$ can be set by adjusting the value of the constant pressure $P_k$ inside the upper chamber of the hydraulic cylinders 28, 29 by means of the pressure control means 50, and by means of the calibration of the electronic amplifier component 43 of the load cell 41, as a function of the following parameters:

(a) the type of the fabric to be rolled;

(b) the largest diameter of the finished fabric roll;

(c) the weight of the finished roll.

It should be observed that by means of the calibration of the electronic amplifier component 43, the weights of both of the tangential fabric-rolling rollers 10, 11 and of the saddle 40 are compensated for, so that the output signal from said electronic component 43 is exclusively proportional to the actual weight of fabric which is progressively generated during the rolling process.

In order to preset the value of the constant load $C_k$ to be maintained during the fabric rolling process, the necessary and sufficient condition is:

$$P_k \geqq C_k-K$$

$$C_k \geqq K$$

If $$P_k=C_k-K,$$

from the above equation it derives that $$P_x=C_y$$

$C_y$ is the actual weight of the fabric during the rolling process, and may practically vary from 0 up to a maximum value of about 2,500 kg.

The variable pressure $P_x$ is an ascending function.

During the process of fabric rolling around the beam, three steps can be identified:

| | | |
|---|---|---|
| i | $Cy < Ck$ | compression step |
| ii | $Cy = Ck$ | equilibrium step |
| iii | $Cy > Ck$ | lifting step |

This means that during the initial fabric rolling step (i.e., the compression step), the beam 18 is pressed downwards against the tangential fabric-rolling rollers 10, 11; when the roll of fabric under formation has reached such a diameter that $C_y=C_k$, the step of equilibrium takes place; and, with the fabric roll being produced furthermore increasing in diameter, the hydraulic cylinders 28, 29 lift the same fabric roll.

In particular, whenever it detects an increase in load ($\Delta C_y$), the load cell 41, which operates under a variable strain within the range of from 2/10 to 4/10 of a mm, transmits a signal, as mV, and, by means of the increasing proportional increase in $P_x$, changes the pressure inside the lower chamber of both hydraulic cylinders 28, 29, controlled by the proportional electrovalve 47. The load applied to said cell decreases by a same value, and the cell returns to its previous working position, i.e., in its position as determined by the calibration of the electronic component 43.

Summing-up, the load cell 41 is continuously assisted by the proportional electrovalve 47, so as to always support a constant load $C_k$.

The positioning of the load cell 41 as depicted in FIG. 2, wherein the load applied to the same cell is hinged on a fulcrum at the roller end opposite to the cell, makes it possible for only half the load to be detected, and therefore a cell of smaller size, hence cheaper, to be selected. A numerical example, given for merely illustrative purposes, will be useful in order to better clarify the three operating steps during the fabric rolling process. Let's suppose that the constant load set is $C_k=400$ kg, and that the weight of the beam 18 is $K=40$ kg. Let's furthermore suppose that the pressure $P_k$ inside the upper chamber of the hydraulic cylinders 28, 29, which should be higher than $C_k-K$, is $P_k=460$ kg.

i. Compression Step:

(a) actual fabric weight $C_y=0$ $$P_x=C_y+P_k+K-C_k==0+460+40-400=100 \text{ kg}$$

(b) actual fabric weight $C_y=200$ kg $$P_x=200+460+40-400=300 \text{ kg}$$

ii. Equilibrium Step:

Actual weight of fabric $C_y$ equal to the constant load $C_k$ $$C_y=C_k=400 \text{ kg}$$

$$P_x=P_k+K=460+40=500 \text{ kg}$$

iii. Lifting Step:

(a) Actual weight of fabric $C_y=1000$ kg $$P_x=1000+460+40-400=1100 \text{ kg}$$

(b) Actual weight of fabric $C_y=2500$ kg $$P_x=2500+460+40-400=2600 \text{ kg}$$

As it results from the above disclosure, thanks to the load control device provided according to the present invention, the load applied to the tangential fabric-rolling rollers by the roll of fabric which is being formed, can be maintained constant, and equal to a presettable value, during the whole rolling process. In that way, the friction forces between the wound fabric of the fabric roll and said fabric-rolling rollers can be maintained constant, so that the integrity of the fabric is secured, even where a delicate fabric is handled, and any dangerous effects on the tangential rolling system are prevented.

In such a way, the possibility of obtaining rolls of up to 1800–2000 mm of diameter, with the end geometry of said fabric rolls being contained within very narrow tolerances, is provided.

What is claimed is:

1. Apparatus for winding a continuous web into a roll, said apparatus comprising:

(a) A rotatable beam about which the web is wound to form the roll, said rotatable beam having opposing ends;

(b) drive means comprising a first roller and a second roller, each having an axis, said first and second rollers positioned so that their axes are parallel to each other and tangentially abut said beam or, alternatively, a roll of the web wound about said beam;

(c) means for supporting said beam so that its roll is disposed against said first and second rollers, said supporting means comprising:

(i) beam guide means for receiving and guiding said opposing ends of said beam to permit said beam to move along a path away from said first and second rollers;

(ii) electronic sensing means responsive to a force applied by the roll to said first and second rollers to provide an output indicative thereof;

(iii) means for lifting said beam, said lifting means comprising:

(a) hydraulic means for receiving a pressurized flow of fluid to lift said beam and the roll thereon; and (b) hydraulic control means including an electrovalve responsive to said electronic sensing output for controlling proportionately the pressure of said fluid flow to said hydraulic means in accordance with said electronic sensing output, whereby the force applied by the roll to said first and second rollers remains substantially constant regardless of the size and weight of the roll.

2. Apparatus as claimed in claim 1, wherein said electronic sensing means is connected to said beam so that said electronic sensing output is proportional only to the weight of the roll.

3. Apparatus as claimed in claim 2, wherein each of said first and second rollers is supported at one of its ends by a first inside support to pivot in a plane, and at the other of its ends by a second inside support mounted on a movable saddle, said saddle resting on said electronic sensing means.

4. Apparatus as defined in claim 1, wherein said electronic sensing means comprises at least one load cell.

5. Apparatus as claimed in claim 1, wherein said hydraulic means comprises first and second hydraulic cylinders, each having an upper chamber, a lower chamber and a piston connected to a corresponding one of said opposing ends to lift said beam, said hydraulic control means comprising first pressure control means for providing a fluid flow of substantially constant pressure to said upper chambers, and a second pressure control means for providing a second fluid flow of a pressure regulated in accordance with said electronic sensing output to said lower chambers.

6. Apparatus as claimed in claim 1, wherein said hydraulic control means comprises:

(a) amplifier means responsive to said electronic sensing output for generating a corresponding amplified output;

(b) transducer means responsive to said amplified output for generating a corresonding transducer output; and (c) said proportionate electrovalve responsive to said transducer output for controlling the pressure of said fluid flow connected to said hydraulic means.

* * * * *